US005832743A

United States Patent [19]

Adamovsky

[11] Patent Number: 5,832,743

[45] Date of Patent: Nov. 10, 1998

[54] SHELL AND TUBE TYPE EVAPORATOR

[76] Inventor: Victor Adamovsky, 110 The Kingsway, Toronto, Ontario, M8X 2V1, Canada

[21] Appl. No.: 858,906

[22] Filed: May 19, 1997

Related U.S. Application Data

[63] Continuation of Ser. No. 587,368, Jan. 16, 1996, abandoned.

[30] Foreign Application Priority Data

Nov. 20, 1995 [CA] Canada ..... 2163318

[51] Int. Cl.[6] ..... F25B 39/02

[52] U.S. Cl. ..... 62/515; 62/527; 165/DIG. 421

[58] Field of Search ..... 62/512, 515, 524, 62/527; 165/159, DIG. 421

[56] References Cited

U.S. PATENT DOCUMENTS

| | | | |
|---|---|---|---|
| 721,310 | 2/1903 | Junkers | 165/DIG. 421 |
| 1,226,299 | 5/1917 | Boltz | 165/159 |
| 4,357,991 | 11/1982 | Cameron | 165/DIG. 421 |
| 4,570,702 | 2/1986 | Stafford et al. | 165/159 |
| 4,815,533 | 3/1989 | Harada et al. | 165/159 |

FOREIGN PATENT DOCUMENTS

| | | | |
|---|---|---|---|
| 578688 | 9/1923 | France | 165/159 |
| 49310 | 10/1993 | Japan | 165/159 |
| 88630 | 3/1921 | Switzerland | 165/159 |

*Primary Examiner*—William E. Tapolcai
*Attorney, Agent, or Firm*—Anthony J. Casella; Gerald E. Hespos; Ludomir A. Budzyn

[57] ABSTRACT

A shell and tube type evaporator using a refrigerant and shell fluid and including a vertically positioned shell having an upper and lower end and substantially parallel tubes longitudinally disposed within the shell. The shell has inlet means near its lower end and outlet means near its upper end for passing the refrigerant through the tubes. The shell also has inlet and outlet means for passing the shell fluid through the shell. Preferably the refrigerant is ammonia and shell fluid is brine.

30 Claims, 2 Drawing Sheets

SHELL AND TUBE TYPE EVAPORATOR

This application is a continuation of application No. 08/587,368 filed Jan. 16, 1996, now abandoned.

FIELD OF THE INVENTION

The present invention relates to the field of refrigeration systems, and, in particular, to shell and tube type evaporators within a refrigeration system.

BACKGROUND OF THE INVENTION

Heat transfer is an important part of the refrigeration process. The transfer of heat from one medium to another is usually accomplished by the use of heat exchangers or evaporators. There are many types such as double pipe, shell and tube, and plate heat exchangers. Although the art of heat exchanger design is highly developed, there remains room for improvement in a number of areas such as reduction of the pressure drop, increasing overall heat transfer, and improving fluid flow distribution.

In a refrigeration system, in the vapour compression cycle, a liquified refrigerant is metered by a thermal expansion or pressure reduction valve into the lower pressure environment of the evaporator. In the evaporator, the refrigerant changes phases from a liquid to a vapour as it absorbs the required heat from the liquid to be cooled. A compressor withdraws the refrigerant vapour from the evaporator, raises its pressure and discharges the refrigerant into the condenser, where the heat absorbed in the evaporator is discarded to a heat sink as the refrigerant changes phase from a vapour to a liquid. The refrigerant is then ready for another cycle.

Typically shell and tube type evaporators are utilized in a variety of industrial settings. These evaporators are usually positioned in a horizontal orientation thereby taking up a large amount of commercial floor space. A refrigerant is passed through the shell of the evaporator in a countercurrent direction to a fluid to be cooled which is passed through the tubes within the evaporator. This system is very inefficient because the fluid to be cooled must pass twice through the tubes at high velocities (5–8 FPS) to achieve sufficient heat transfer. As well, large amounts of the refrigerant, usually ammonia, must be us ed in the shell in order to fill the shell space. This raises the potential hazard of a leak or spill of the toxic and en vironmentally hazardous chemical.

Typical shell and tube type evaporator systems have a surge drum attached to the evaporator to ensure a complete liquid refrigerant separation. The surge drum is external to the evaporator occupying additional expensive industrial space.

SUMMARY OF THE INVENTION

It is an object of the present invention to provide a shell and tube type evaporator which is vertical.

It is a further object of the present invention to provide a shell and tube type evaporator with improved heat exchange efficiency.

It is a further object of the present invention to provide a shell and tube type evaporator with improved flow of fluid to be cooled through the shell of the evaporator.

The present invention overcomes the disadvantages of the prior art and provides a shell and tube type evaporator comprising a shell having an upper and a lower end; substantially parallel tubes longitudinally disposed within said shell; first inlet means aid outlet means for passing the refrigerant through said tubes, said inlet means positioned near the lower end of said shell and said outlet means positioned near the upper end of said shell; and second inlet means and outlet means for passing the shell fluid through said shell, whereby heat is transferred between the refrigerant and the shell fluid.

BRIEF DESCRIPTION OF DRAWINGS

Preferred embodiments of the present invention will now be described and may be better understood when read in conjunction with the following drawings in which.

DETAILED DESCRIPTION OF PREFERRED EMBODIMENT

Figure 1:
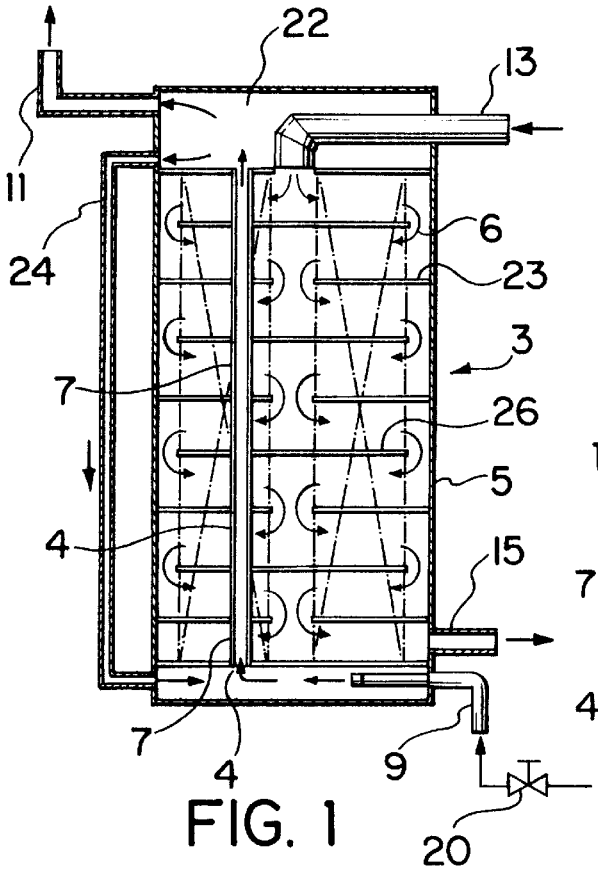
FIG. 1 is a schematic cross sectional view of one embodiment of the present invention which depicts the flow of the refrigerant and the shell fluid flowing through the evaporator.

Referring to FIG. 1, the evaporator 3 of the present invention is shown. The evaporator 3 is oriented vertically rather than horizontally as are typical evaporators. This orientation has surprisingly increased the efficiency of the evaporator 3 and the heat transfer between the refrigerant 4 and shell fluid 6 while occupying significantly less floor space in an industrial area. Despite the numerous failures in the past of other attempts to develop vertical systems, the present invention successfully utilizes a vertical evaporator which produces more efficient heat transfer using a fluid pump motor with a lower horsepower rating and lower energy consumption than a typical horizontal evaporator thereby reducing the associated operating costs. It also requires less refrigerant, which substantially reduces the risk to workers exposed to this toxic and expensive substance.

Figure 2:
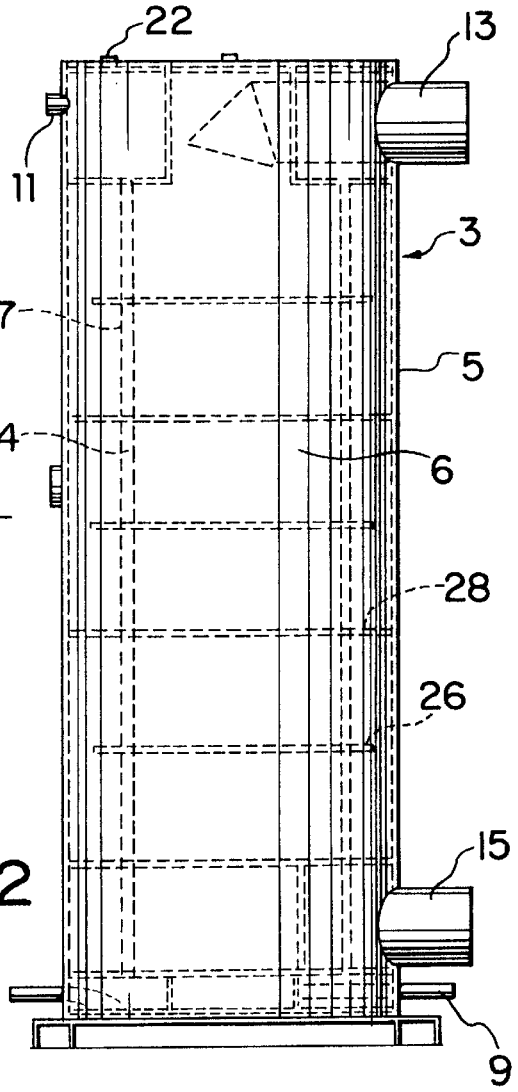
FIG. 2 is a cross sectional view of the evaporator unit depicted in FIG. 1.

The evaporator 3 of the present invention shown in detail in FIGS. 1 and 2, is a shell and tube type evaporator 3. It consists of a cylindrical shell 5, a bundle of parallel tubes 7 longitudinally disposed within the shell 5, refrigerant inlet means 9 and refrigerant outlet means 11 for introducing a refrigerant 4 to and withdrawing the refrigerant 4 from the tubes 7, and shell fluid inlet means 13 and shell fluid outlet means 15 for introducing a shell fluid 6 to and withdrawing the shell fluid 6 from the interior of the evaporator shell 5. An integral surge drum 22 is located within the top portion of the evaporator 3. Indirect heat transfer between the refrigerant 4 and shell fluid 6 is effected by passing the refrigerant 4 through the tubes 7 while passing the shell fluid 6 through the shell 5, whereby the refrigerant 4 and shell fluid 6 can travel in concurrent or countercurrent flow relation. Countercurrent flow results in a more efficient heat transfer between the refrigerant 4 and the shell fluid 6.

In the present invention, the refrigerant 4 may be any refrigerant commonly used in evaporators such as ammonia or freon. Preferably, the refrigerant is ammonia. As well the shell fluid 6 may be any commonly-used cooling medium such as water, ethylene or propylene glycols, various heat transfer fluids, air, various industrial gases, or brine made of water and sodium chloride or calcium chloride. Preferably, the shell fluid 6 is brine comprised of water and calcium chloride.

Figure 4:
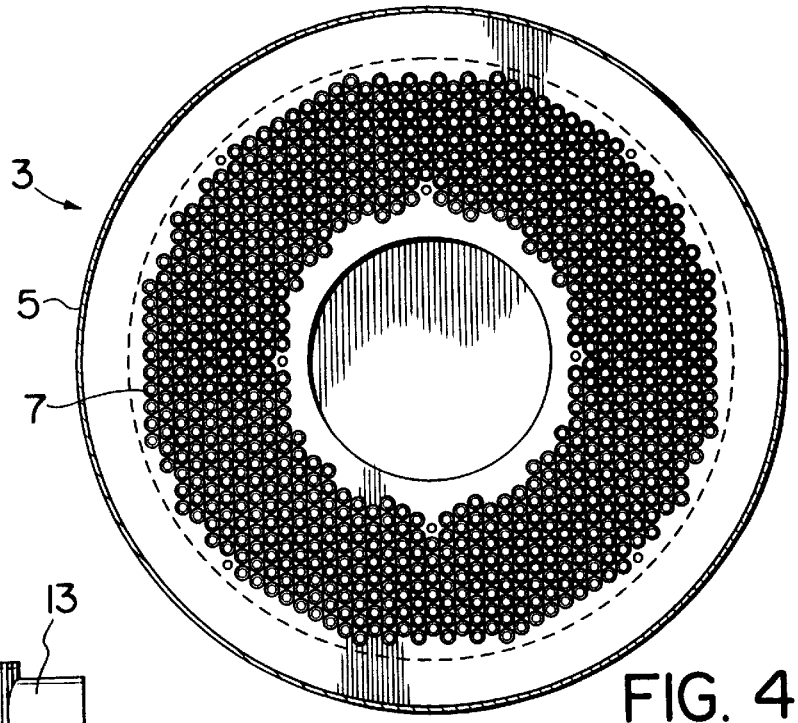
FIG. 4 is a schematic top view of the evaporator of FIG. 1 showing the tube and baffle layout.
Figure 3:
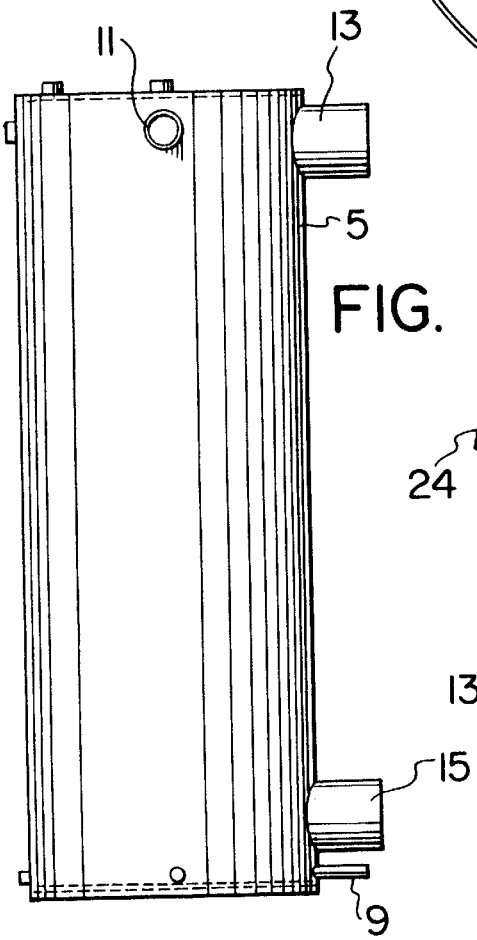
FIG. 3 is a side view of the evaporator of FIG. 1.
Figure 5:
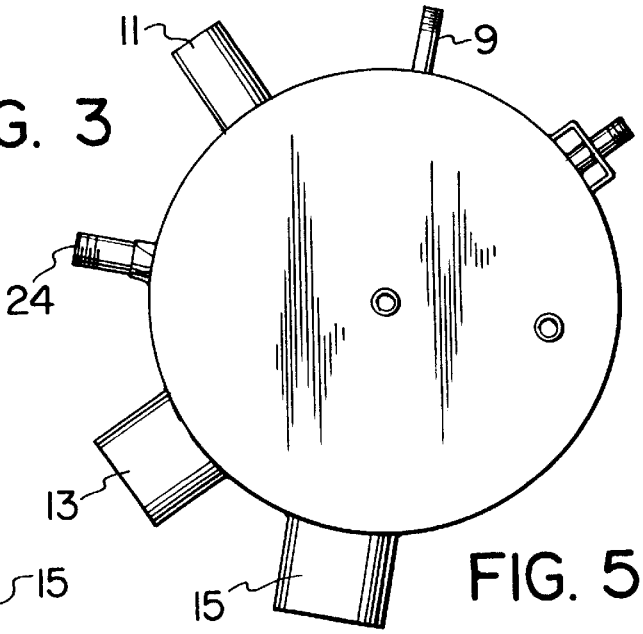
FIG. 5 is a top schematic view of one embodiment of the evaporator of FIG. 1.

The interior design of the shell 5 is shown in more detail in FIG. 4. The tubes 7 are laid out in a concentric circular arrangement. The tubes 7 may range in size from ¼" to 1" in diameter. Preferably, they are approximately ⅝" in diameter for increased efficiency. Each tube 7 should be identical in size to maintain an even flow of the refrigerant 4 through the tubes 7.

Within the interior of the shell 5 are baffles 26, 28. Ring and disk baffles 26, 28 are arranged throughout the height of the shell 5 to direct the flow of the brine 6 to maximize the heat transfer between the brine 6 and the refrigerant tubes 7. The arrangement of the baffles 26, 28 is more clearly shown in FIG. 1 where arrows indicate the flow of the brine 6 through the shell 5 and around the tubes 7 and alternating layers of ring and disk baffles 26, 28.

The evaporator 3 is connected within a typical refrigeration system, not shown within the figures. High pressure ammonia 4 enters the evaporator 3 from a condenser through a pressure reduction valve 20. The pressure of the ammonia is significantly reduced by the pressure reduction valve 20. The ammonia will enter the pressure reduction valve at a pressure of approximately 175 to 185 psi. It will exit the pressure reduction valve and enter the tubes of the evaporator at a pressure of approximately 20 to 25 psi. The reduced pressure of the ammonia allows it to boil changing from its liquid state to a gaseous state. The reduced pressure of the ammonia 4 represents a lower temperature of approximately 10 degrees F. This temperature is considered the normal working temperature of the evaporator 3.

The liquid ammonia 4 enters the evaporator tube 7, from the condenser and pressure reduction valve 20 at a velocity of approximately 45 to 50 feet/min. This high velocity provides an even distribution and feeding of every tube 7 in the evaporator 3.

As the ammonia flows upwards through the tubes 7 in the evaporator 3, a thermosyphon effect is created. Because the pressure of the ammonia 4 is reduced representing a lower temperature near its boiling point, the ammonia 4 will begin to evaporate as it travels upwards through the tubes 7, utilizing heat gained from the shell fluid to change phases from liquid to vapour. The liquid content will gradually decrease as the vapour content increases and the ammonia 4 approaches the top end of the tubes 7 and the top of the evaporator 3. As the ammonia liquid 4 evaporates, the ammonia volume and the velocity increase. Because the ammonia flow is restricted to the inside of each tube 7 and is increasing in volume and therefore in upward velocity, it creates a thermosyphon effect, carrying liquid ammonia which does not have the chance to evaporate along with the vapour ammonia. The ammonia 4 exits at the top of the tubes 7 at an exit velocity significantly faster than its entrance velocity, at, for example, approximately 270 to 275 feet/min. This velocity is approximately 6 times faster than the velocity of the ammonia 4 as it entered the evaporator 3.

The cooling effect takes place along the internal surface of the tubes 7 within the evaporator 3 as heat is transferred from the evaporating ammonia 4 to the brine 6. The ammonia 4 exits the tubes 7 and enters the integral surge drum 22 positioned at the top of the evaporator 3. Here, the velocity of the ammonia 4 is reduced from its speed of approximately 270 feet/min in the tubes 7 to approximately 50 feet/min. At this point, the liquid ammonia 4 carried along with the vapour separates from the vapour stream and falls to the bottom of the surge drum 22. This liquid ammonia 4 can not re-enter the tubes 7 due to the high exit velocity of the vapour ammonia 4. The liquid 4 therefore drains down to the bottom of the evaporator 3 by means of the thermosyphon return line 24. It re-enters the bottom of the tubes 7. Approximately ten percent of the liquid ammonia 4 which enters the evaporator circulates within the surge drum 22 and thermosyphon return line 24.

At the same time refrigerant is circulating through the tubes 7, shell fluid circulates outside the tubes 7 within the shell 5 of the evaporator 3. The calcium chloride brine 6 enters the top of the evaporator 3 through the warm shell fluid inlet 13. The brine 6 flows down through the inside of the shell 5 and exits out the bottom of the evaporator 3 through the shell fluid outlet 15. The warm brine inlet 13 at the top of the evaporator 3 allows for additional evaporation at the top section of the evaporator 3 due to the higher temperature differential between the brine entering the shell of the evaporator and the liquid ammonia approaching the top of the tubes 7. It also provides thermal forces for the thermosyphon effect in the tubes 7, by providing heat to drive the phase change of the ammonia from a liquid to a vapour state, thereby increasing the volume and velocity of the ammonia in the tubes 7.

The brine flow is directed through the inside of the shell 5 and to the outside surface of the tubes 7 by a set of disk baffles 26 and ring baffles 28. The application of the disk 26 and ring baffles 28 allows the brine 6 to completely circulate throughout the shell 5 and maximize contact between the brine and the outside surface of the tubes 7. This system maximizes heat transfer by fully utilizing the external surface of the tubes 7. The baffles 26, 28 eliminate any dead sections in the flow of the brine 6 on the bundle of tubes 7 and within the shell 5 and provide for a substantially constant velocity around the tubes 7. Good brine turbulence between the tubes 7 increases the efficiency of the heat transfer. As a result, the evaporator 3 of the present invention requires less area and is about twenty five percent smaller than the typical horizontal unit to achieve similar heat transfer.

The brine velocity is maintained in the range of 1 to 1.5 feet/sec. This low velocity ensures that the total pressure drop is in the range of 4.5 to 5 psi. This represents a pressure drop of about three times lower than in a comparable horizontal unit. This small pressure drop in the brine 6 will allow a smaller fluid pump motor to be used, approximately 20 horsepower instead of the 30 horsepower now required in typical horizontal evaporator units. This saving on the motor size is critical to the efficiency of the system since the heat generated by the pump motor must be removed by the refrigeration compressor.

While the invention has been described with reference to one preferred embodiment, those skilled in the art will understand that modifications and alterations may be made without departing from the scope of the invention. Therefore, it is intended that the invention should not be limited by the foregoing description.

We claim:

1. A shell and tube type evaporator using a refrigerant and shell fluid comprising:

a shell having an upper end and a lower end;

substantially parallel tubes longitudinally disposed within said shell, each said tube having opposed upper and lower ends;

first inlet means and first outlet means for passing the refrigerant through said tubes in an upwardly direction from said lower end of said shell to said upper end of said shell, said first inlet means being positioned near the lower end of said shell and being in communication with the lower ends of the tubes, said first outlet means being positioned near the upper end of said shell and being in communication with the upper ends of the tubes, said first inlet means including a pressure reduction device allowing the refrigerant to pass through said tubes at a pressure suitable for changing said refrigerant from a substantially liquid phase at said first inlet means to a substantially gaseous phase at said first outlet means; and second inlet means and second outlet means for passing the shell fluid through said shell, whereby heat is transferred between the refrigerant and the shell fluid.

2. A shell and tube type evaporator according to claim 1 wherein said second inlet means is positioned near said upper end of said shell and said second outlet means is positioned near the lower end of said shell.

3. A shell and tube type evaporator according to claim 2 further comprising a pressure reduction valve connected to said first inlet means wherein the pressure of the refrigerant is reduced before it enters said tubes.

4. A shell and tube type evaporator according to claim 3 further comprising an integral surge drum connected to said first outlet means whereby refrigerant enters said integral surge drum from said tubes and the velocity of the refrigerant is reduced.

5. A shell and tube type evaporator according to claim 4 further comprising a return line from said surge drum to said lower end of said shell whereby liquid refrigerant entering said integral surge drum is carried to the lower end of said shell.

6. A shell and tube type evaporator according to claim 5 further comprising at least one baffle within said shell to direct the flow of the shell fluid.

7. A shell and tube type evaporator according to claim 6 wherein said evaporator has more than one baffle.

8. A shell and tube type evaporator according to claim 6 wherein said baffles are disk baffles.

9. A shell and tube type evaporator according to claim 7 wherein said baffles are disk baffles.

10. A shell and tube type evaporator according to claim 6 wherein said baffles are ring baffles.

11. A shell and tube type evaporator according to claim 7 wherein said baffles are ring baffles.

12. A shell and tube type evaporator according to claim 6 wherein said second inlet means for the shell fluid is warm.

13. A shell and tube type evaporator according to claim 12 wherein the refrigerant is ammonia, propane or freon.

14. A shell and tube type evaporator according to claim 13 wherein the refrigerant is ammonia.

15. A shell and tube type evaporator according to claim 12 wherein the shell fluid is brine, water, glycols, air or industrial gases.

16. A shell and tube type evaporator according to claim 14 wherein the shell fluid is brine, water, glycols, air or industrial gases.

17. A shell and tube type evaporator according to claim 15 wherein the shell fluid is brine.

18. A shell and tube type evaporator according to claim 16 wherein the shell fluid is brine.

19. A shell and tube type evaporator according to claim 17 wherein said brine is water with calcium chloride.

20. A shell and tube type evaporator according to claim 18 wherein said brine is water with calcium chloride.

21. A shell and tube type evaporator utilizing refrigerant and shell fluid comprising:

a shell oriented in a vertical direction and having an upper end and a lower end;

substantially parallel tubes longitudinally disposed within said shell, said tubes each having upper and lower ends and external surfaces;

first inlet means and first outlet means for passing the refrigerant into and out of said tubes in an upward direction from said lower end of said shell to said upper end of said shell, said first inlet means being positioned near said lower end of said shell and being in communication with the lower ends of the tubes, first outlet means being positioned near the upper end of said shell and being in communication with the upper ends of the tubes, said first inlet means including a pressure reduction device allowing the refrigerant to pass through said tubes at a pressure suitable for changing said refrigerant from a substantially liquid phase at said first inlet means to a substantially gaseous phase at said first outlet means;

second inlet means and second outlet means for passing the shell fluid into and out of said shell;

baffles within said shell arranged within alternating horizontal planes, whereby said baffles redirect the flow of the shell fluid within said shell to increase contact between the shell fluid and the external surfaces of said tubes.

22. A shell and tube type evaporator according to claim 21 wherein said baffles are comprised of alternating layers of disk and ring baffles which redirect the flow of the shell fluid to maximize the contact between the shell fluid and exterior surface of said tubes and to decrease the amount of areas within the shell with poor or no flow.

23. A shell and tube type evaporator according to claim 22 wherein said refrigerant is ammonia, propane or freon.

24. A shell and tube type evaporator according to claim 23 wherein said refrigerant is ammonia.

25. A shell and tube type evaporator according to claim 23 wherein said shell fluid is brine, water, glycols, air or industrial gases.

26. A shell and tube type evaporator according to claim 24 wherein said shell fluid is brine, water, glycols, air or industrial gases.

27. A shell and tube type evaporator according to claim 25 wherein said shell fluid is brine comprised of water and calcium chloride.

28. A shell and tube type evaporator according to claim 25 wherein said shell fluid is brine comprised of water and calcium chloride.

29. A shell and tube type evaporator according to claim 22 further comprising an integral surge drum connected to said tubes whereby refrigerant from said tubes enters said surge drum and the velocity of the refrigerant is reduced.

30. A shell and tube type evaporator according to claim 29 further comprising a return line from said surge drum to said lower end of said shell whereby liquid refrigerant entering said integral surge drum is carried to the lower end of said shell.

* * * * *